US006296512B1

(12) United States Patent
Akeda

(10) Patent No.: US 6,296,512 B1
(45) Date of Patent: Oct. 2, 2001

(54) PRESS-CONNECTING TERMINAL

(75) Inventor: Nobuyuki Akeda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/630,764

(22) Filed: Aug. 2, 2000

(30) Foreign Application Priority Data

Aug. 18, 1999 (JP) ..... 11-231785

(51) Int. Cl.[7] ..... H01R 4/24; H01R 4/26; H01R 11/20

(52) U.S. Cl. ..... 439/397; 439/399

(58) Field of Search ..... 439/397, 399, 439/406, 407, 400

(56) References Cited

U.S. PATENT DOCUMENTS 4,291,935 * 9/1981 Badoz et al. ..... 439/399
5,588,868 * 12/1996 Tsuji et al. ..... 439/397
6,007,365 12/1999 Atsumi et al. ..... 439/397

FOREIGN PATENT DOCUMENTS 844688 5/1998 (EP) .
54-132783 3/1978 (JP) .
3-94768 9/1991 (JP) .
10-154535 6/1998 (JP) .

OTHER PUBLICATIONS

Japanese Patent Abstract 844688 Jun. 9, 1998.

* cited by examiner

*Primary Examiner*—Brian Sircus
*Assistant Examiner*—Javaik Nasri
(74) *Attorney, Agent, or Firm*—Sughrue, Mion, Zinn, Macpeak & Seas, PLLC

(57) ABSTRACT

A press-connecting terminal (1) includes a plurality of press-connecting blades (9, 10). A gap between the pair of press-connecting blades (9) is smaller than the diameter of the electric wire (7), and a gap between the pair of press-connecting blades (10) is smaller than a diameter of a conductor (7*b*) of the electric wire (7). When the electric wire (7) is press-fitted relative to the press-connecting blades (9, 10), an end portion of the electric wire (7) is held by the pair of press-connecting blades (9) while the conductor (7*b*) is press-connected to the pairs of press-connecting blades (10) in electrically-contacted relation thereof. In so far as a variation in diameter of the electric wire (7) is within a predetermined range, the good press-connecting operation is effected, and the press-connecting terminal (1) has enhanced versatility.

14 Claims, 8 Drawing Sheets

PRESS-CONNECTING TERMINAL

BACKGROUND OF THE INVENTION

1. Field of the Invention

The present invention relates to a press-connecting terminal used in the wiring in a vehicle. More particularly, the present invention relates to a structure of pairs of press-connecting blades which can rapidly and positively grip and electrically contact any one of electric wires of various sizes to be press-connected to the press-connecting terminal.

The present application is based on Japanese Patent Application No. Hei. 11-231785, which is incorporated herein by reference.

2. Description of the Related Art

In a vehicle having various electronic equipment mounted thereon, press-connecting terminals have been extensively used in the connection between the electronic equipment and in the connection between electric wire harnesses. One known conventional press-connecting terminal 30, shown in FIGS. 7 to 11, includes a connection portion 31 for connection to a mating press-connecting terminal (not shown), a press-connecting portion 32 of an upwardly-open channel-shaped cross-section for press-connection to an end portion of an electric wire 21, and barrel portions 33 for clamping or gripping the electric wire 21. A resilient contact piece portion 35 is provided within the connection portion 31, and the mating press-connecting terminal, inserted into the connection portion 31 through an insertion opening 31*a* formed in a front end thereof, contacts this resilient contact piece portion 35. A lance 36, formed on an upper surface of the connection portion 31, serves to retain the press-connecting terminal against withdrawal when the press-connecting terminal is inserted into a connector housing (not shown). A stabilizer 37 serves to control the direction of insertion of the press-connecting terminal.

The press-connecting portion 32 includes two pairs of front and rear press-connecting blades 41 and 42. As shown in FIG. 10, the front press-connecting blades 41 are formed by inwardly bending a pair of stamped-out piece portions 44 of opposed right and left side plates 39 of the press-connecting portion 32, and a press-connecting groove 45 is formed between the pair of piece portions 44. The width of the press-connecting groove 45 is smaller than the diameter of a conductor 23 of the electric wire 21. FIG. 10 is a cross-sectional view taken along the line X—X of FIG. 9.

As shown in FIG. 8, the rear press-connecting blades 42 are formed by stamping out a relevant portion of a bottom plate 47 and then by bending this stamped-out portion upwardly in perpendicular relation to the bottom plate 47. The rear press-connecting blades 42 are spaced a predetermined distance from the front press-connecting blades 41. As shown in FIG. 11, a press-connecting groove 49 is formed between the pair of press-connecting blades 42, and the width of this press-connecting groove 49 is equal to the width of the press-connecting groove 45. FIG. 11 is a cross-sectional view taken along the line XI—XI of FIG. 9.

Next, the process of press-connecting the electric wire 21 will be described. The end portion of the electric wire 21 is press-fitted toward the press-connecting blades 41 and 42 from the upper side of the press-connecting portion 32 as indicated by an arrow in FIG. 7. As a result, opposed side edges of the press-connecting groove 45, formed between the press-connecting blades 41, and opposed side edges of the press-connecting groove 49, formed between the press-connecting blades 42, cut a sheath 22 of the electric wire 21, so that the conductor 23 of the electric wire is brought into contact with the side edges of these press-connecting grooves 45 and 49, as shown in FIGS. 10 and 11. Then, the electric wire 21 is clamped by the pair of barrel portions 33 through the sheath 22, thus completing the fixing of the electric wire 21 to the press-connecting terminal 30.

In the case where the electric wires 21 to be used have various diameters, that is, their respective conductors 23 have different diameters, the press-connecting terminal 30 can not be suitably used for all of these electric wires 21 of different diameters since the width of the press-connecting grooves 45 and 49 is fixed, and therefore there has been encountered a problem that there have been needed various press-connecting terminals each for exclusive use with the electric wire 21 of a particular diameter.

Particularly, unless the conductor 23 is adequately press-connected to the press-connecting blades 41 and 42 of the conventional press-connecting terminal 30, a contact electrical resistance at the press-connecting position increases, and as a result problems, such as the generation of heat, have been encountered. In order to prevent such problems, it is necessary to prepare many kinds of press-connecting terminals having the respective press-connecting grooves whose widths correspond to the electric wires 21 of various sizes, respectively. However, this is obviously disadvantageous from the viewpoints of the material control, the processing of the parts, the assembling operation, the maintenance and so on.

SUMMARY OF THE INVENTION

With the above problems in view, it is an object of the present invention to provide a press-connecting terminal which can rapidly and positively grip and electrically contact any one of electric wires of various sizes (varying in diameter over a relatively-wide range) to be press-connected to the press-connecting terminal.

To achieve the above object, according to the first aspect of the present invention, there is provided a press-connecting terminal which comprises an electrically-conductive plate including a connection portion electrically connectable to another terminal, and a press-connecting portion to which an electric wire including a conductor and a sheath circumscribing the conductor is electrically connectable, a first pair of press-connecting blades disposed in the press-connecting portion, the first pair of press-connecting blades being opposed to each other to form therebetween a first gap into which the electric wire is insertable so that an outer surface of the sheath of the electric wire is gripped between the first pair of press-connecting blades, and a second pair of press-connecting blades disposed in the press-connecting portion, the second pair of press-connecting blades being opposed to each other to form therebetween a second gap into which the electric wire is insertable so that the sheath of the electric wire is pierced by the second pair of press-connecting blades, and the conductor of the electric wire is electrically connected to the second pair of press-connecting blades.

According to the second aspect of the present invention, it is preferable that the width of the first gap is slightly larger than the width of the second gap.

According to the third aspect of the present invention, it is preferable that when the electric wire is inserted into the first and second gaps, the first and second pairs of press-connecting blades are respectively arranged in intersecting relation to an axis of the electric wire.

According to the fourth aspect of the present invention, it is preferable that the second pair of press-connecting blades have edged portions for piercing the sheath of the electric wire.

According to the fifth aspect of the present invention, it is preferable that the first pair of press-connecting blades are located adjacent to the connection portion.

According to the sixth aspect of the present invention, it is preferable that the press-connecting terminal further comprises a third pair of press-connecting blades formed in the press-connecting portion, the third pair of press-connecting blades being opposed to each other to form therebetween a third gap into which the electric wire is insertable so that the sheath of the electric wire is pierced by the third pair of press-connecting blades, and the conductor of the electric wire is electrically connected to the third pair of press-connecting blades.

According to the seventh aspect of the present invention, it is preferable that the first, second and third pairs of press-connecting blades are respectively arranged in substantially parallel with each other.

According to the eighth aspect of the present invention, it is preferable that the electrically-conductive plate includes a bottom plate, wherein the press-connecting portion includes a pair of side plates extending upwardly in the same direction from opposite sides of the bottom plate, and wherein the first, second and third pairs of press-connecting blades are extended respectively from the side plates, and are located above the bottom plate.

According to the ninth aspect of the present invention, it is preferable that the electrically-conductive plate includes a bottom plate, and wherein the press-connecting portion includes a pair of clamping pieces for clamping the electric wire through the sheath thereof, the pair of clamping pieces extending upwardly from opposite sides of the bottom plate.

According to the eleventh aspect of the present invention, it is preferable that the first pair of press-connecting blades serve only as means for gripping the outer surface of the sheath of the electric wire, and the second and third pairs of press-connecting blades serve only as means for piercing the sheath of the electric wire and for electrically connecting with the conductor of the electric wire.

According to the twelfth aspect of the present invention, it is preferable that first tapering guide-surfaces are formed on the first pair of press-connecting blades to be downwardly inclined respectively toward the first gap, second tapering guide-surfaces are formed on the second pair of press-connecting blades to be downwardly inclined respectively toward the second gap, and third tapering guide-surfaces are formed on the third pair of press-connecting blades to be downwardly inclined respectively toward the third gap, and wherein the electric wire is inserted into the first, second and third gaps while being guided by the first, second and third tapering guide-surfaces.

With the above-described construction, one pair of the press-connecting blades can allow any one of the electric wires (varying in diameter from a predetermined maximum value to a predetermined minimum value) to be press-fitted into the gap therebetween while gradually compressing and deforming the sheath and conductor by their respective tapering guide surfaces, so that these press-connecting blades positively grip the electric wire through the sheath in a press-connected manner.

On the other hand, the other pair of the press-connecting blades gradually compress and deform the sheath and conductor of the electric wire, press-fitted therein, by their respective edged, tapering guide surfaces in accordance with the diameter of the electric wire, and then the edged, tapering guide surfaces cut the sheath, and the downwardly-extending inner surface portions of these blades, defining the gap therebetween, contact exposed portions of the conductor, thereby obtaining a good electrically-connected condition.

Further, when the press-connecting terminal is fittingly connected to an electronic equipment or the like, at least one pair of the press-connecting blades located adjacent to the connection portion positively hold the electric wire within the press-connecting portion against an external force, such as external vibrations and a pulling force, applied to the electric wire.

Furthermore, there are provided the plurality of pairs of press-connecting blades which can electrically contact the conductor of the electric wire in a press-connected manner, and therefore the areas of contact of the downwardly-extending inner surface portions (which define the respective gaps) of these press-connecting blades with the conductor are increased, and the contact resistance thereof is greatly reduced, so that the good electrically-connected condition is obtained.

DETAILED DESCRIPTION OF THE PREFERRED EMBODIMENT

One preferred embodiment of a press-connecting terminal of the present invention will now be described in detail with reference to FIGS. 1 to 6.

Figure 1:
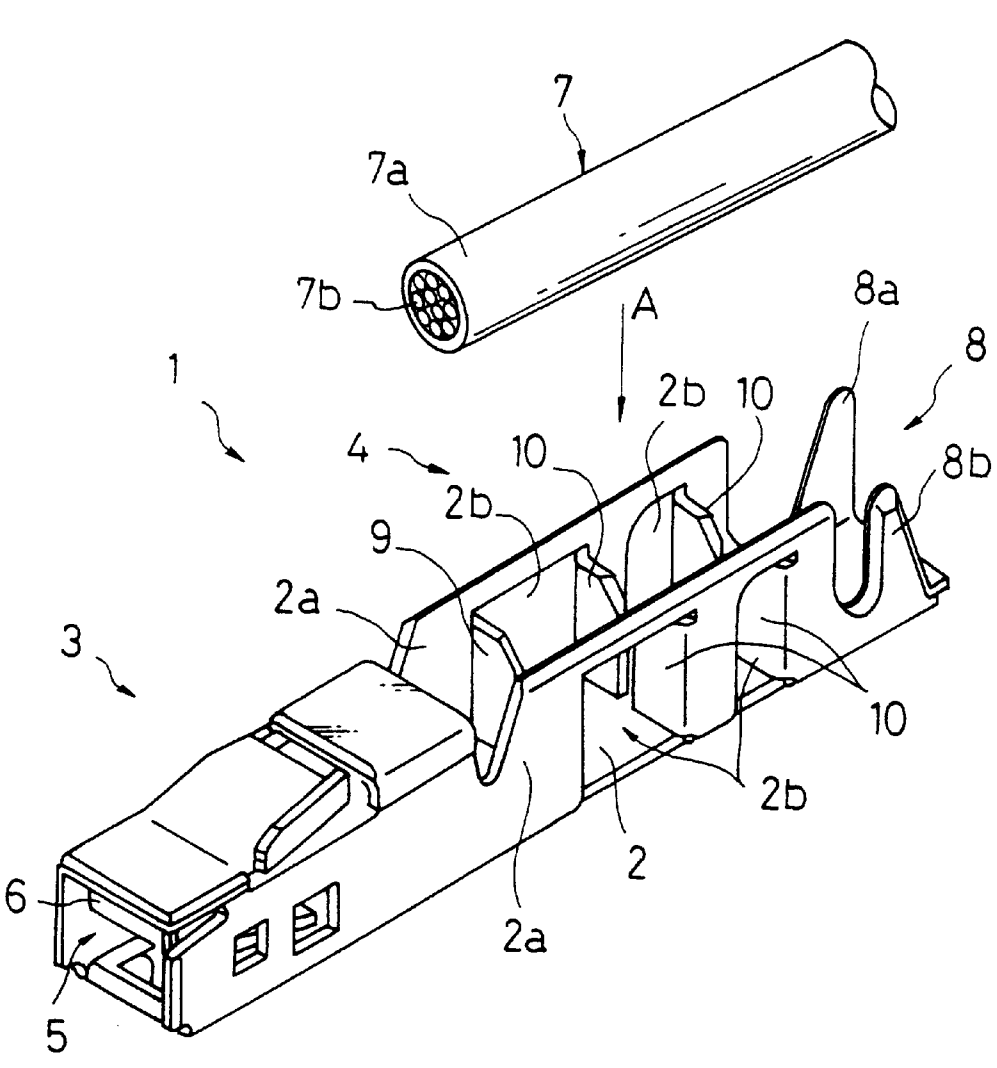
FIG. 1 is a perspective view of a press-connecting terminal of the present invention.
Figure 2:
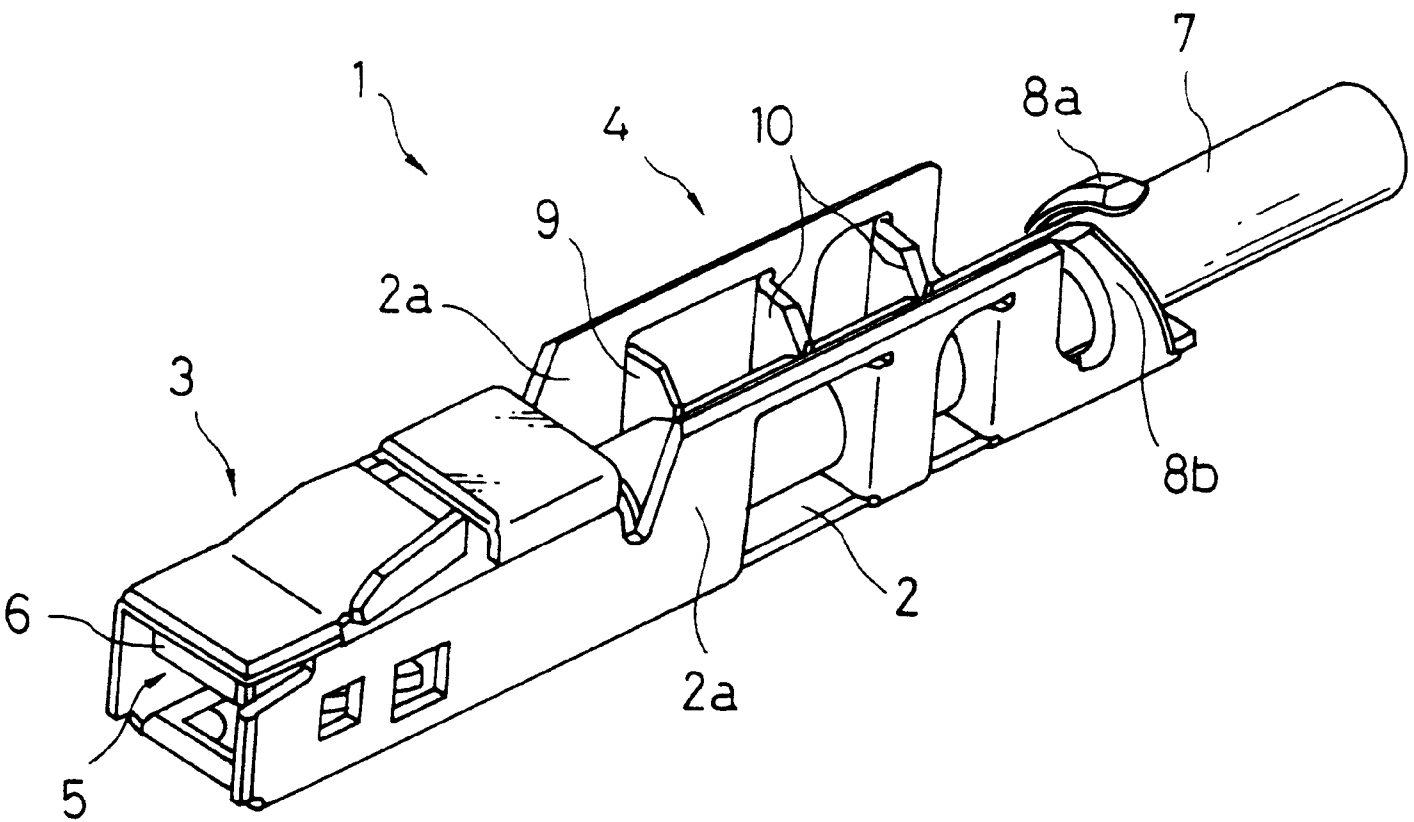
FIG. 2 is a perspective view of the press-connecting terminal of FIG. 1 in which an electric wire is press-fitted.

The press-connecting terminal 1 of the present invention, shown in FIG. 1, is formed by cutting and bending an electrically-conductive metal plate 2, and this terminal 1 broadly includes a connection portion 3 and a press-connecting portion 4. The connection portion 3 is electrically connected to another terminal of a mating connector (not shown), and an insertion opening 5 for receiving the mating connector is formed at a front end of the connection portion 3. A resilient contact piece portion 6 for resilient, electrical contact with the mating connector is provided within an internal space of the connection portion 3 communicating with the insertion opening 5.

The press-connecting portion 4 includes a barrel 8 having a pair of clamping pieces for clamping or gripping the electric wire 7 through a sheath 7*a* in intersecting relation to the centerline (axis) of the electric wire 7. The press-connecting portion 4 further includes a pair of press-connecting blades 9 which are press-connected to the electric wire 7 to grip the same through the sheath 7*a* as described above for the barrel 8, and two pairs of press-connecting blades 10 which pierce the sheath 7*a*, and are press-connected to the conductor 7*b* in intersecting relation to the axis of the electric wire so as to electrically connect to the conductor 7*b*.

Figure 3:
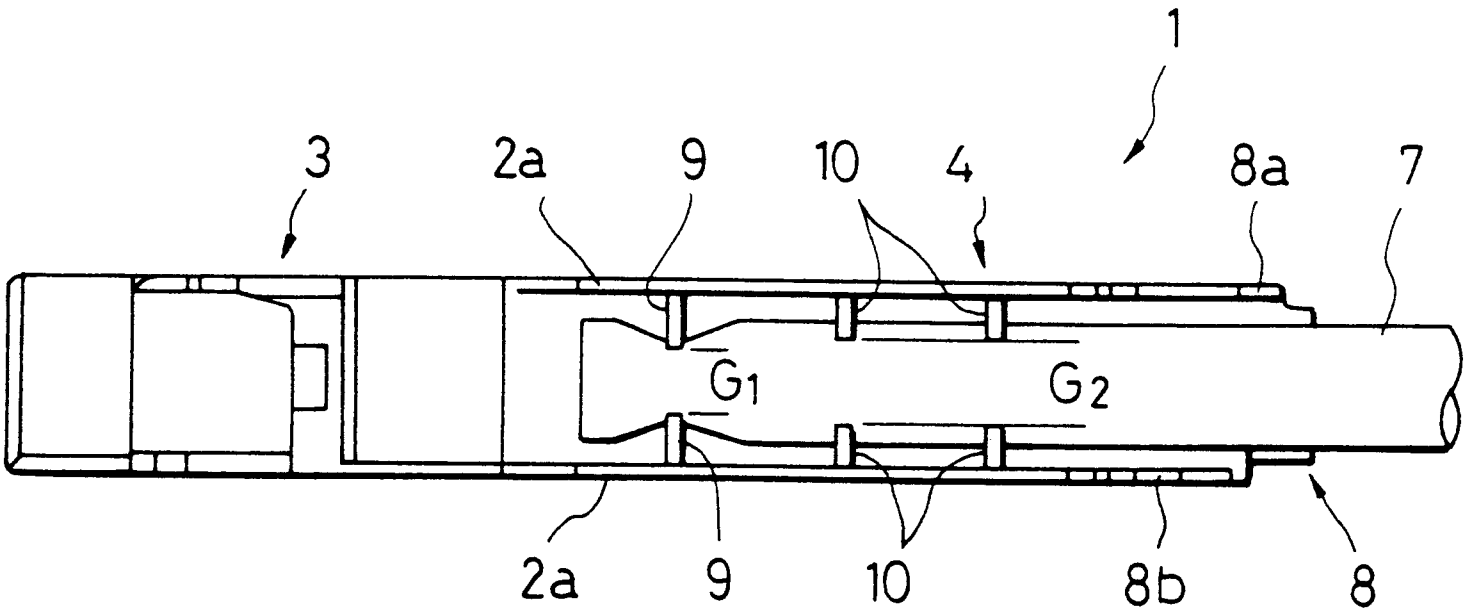
FIG. 3 is a plan view of the press-connecting terminal of FIG. 2.
Figure 5:
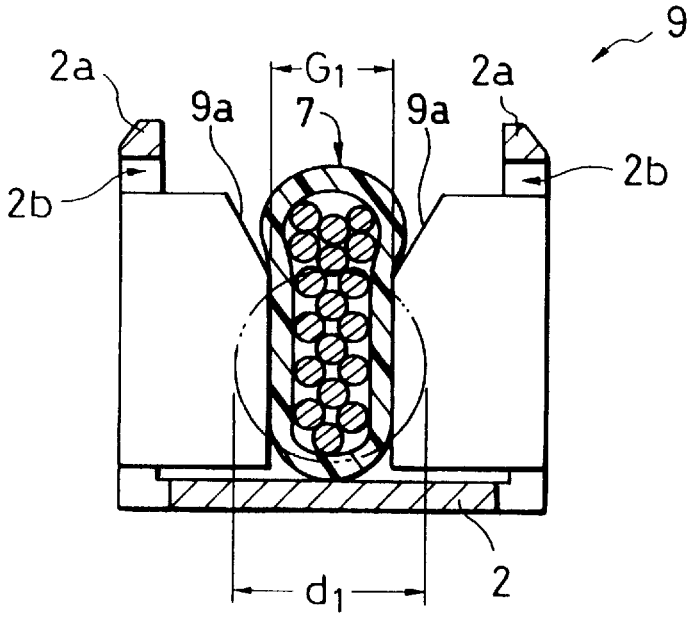
FIG. 5 is a transverse cross-sectional view showing press-connecting blades which can be press-connected to a sheath of the electric wire to grip the same.

As shown in FIGS. 3 and 5, the pair of press-connecting blades 9 have tapering (slanting) guide surfaces 9*a* formed respectively at upper portions thereof, and these tapering guide surfaces 9*a* are slanting downwardly toward the axis of the electric wire 7 so as facilitate the press-fitting of the electric wire 7. The pair of press-connecting blades 9 are opposed to each other, and those portions of opposed inner surfaces (or edges) of these blades 9, extending downwardly respectively from the tapering guide surfaces 9*a* thereof, are spaced such a distance (gap) $G_1$ from each other as to grip even the sheath 7*a* of the electric wire 7 of the smallest diameter in a press-connected manner.

As shown in FIG. 5, the gap $G_1$ is smaller than the diameter $d_1$ of the electric wire 7 ($G_1<d_1$). Therefore, when the electric wire 7 is press-fitted into the gap $G_1$, the electric wire 7 is deformed as indicated in solid lines in FIG. 5, and is gripped or held by the opposed inner surfaces (or edges) of the press-connecting blades 9, defining the gap $G_1$, in a press-connected manner.

Figure 4:
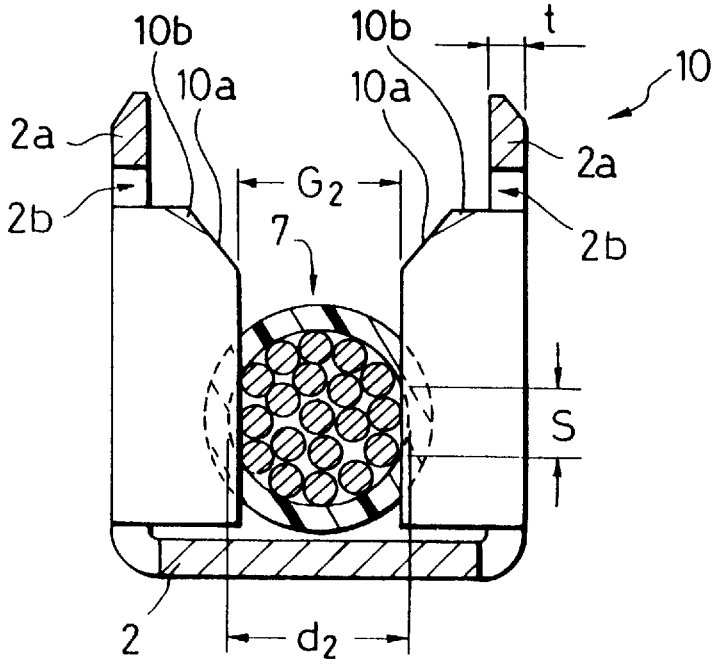
FIG. 4 is a transverse cross-sectional view showing press-connecting blades which can be press-connected to a conductor of the electric wire in electrically-contacted relation thereto.

On the other hand, as shown in FIGS. 3 and 4, each of the other pairs of press-connecting blades 10 have edged, tapering (slanting) guide surfaces 10*a* formed respectively at upper portions thereof, and these tapering guide surfaces 10*a* are slanting downwardly toward the axis of the electric wire 7. Particularly, an upper portion of each edged, tapering guide surface 10*a* is formed into a shape cutting edge 10*b* by cutting, whereas a lower portion of the edged, tapering guide surface 10*a* is flat.

Each pair of press-connecting blades 10 are opposed to each other, and those portions (hereinafter referred to as "downwardly-extending inner surface portions) of the opposed inner surfaces (or edges) of these blades 10, extending downwardly respectively from the edged, tapering guide surfaces 10*a* thereof, are spaced such a distance (gap) $G_2$ from each other as to electrically contact the conductor 7*b* of the electric wire 7 in a press-connected manner. This gap $G_2$ is slightly larger than the gap $G_1$ between the pair of opposed press-connecting blades 9.

The pair of press-connecting blades 9 can allow any one of the electric wires 7 (varying in diameter from a predetermined maximum value to a predetermined minimum value) to be press-fitted in a direction of arrow A into the gap G1 therebetween while gradually compressing and deforming the sheath 7*a* and conductor 7*b* by their respective tapering guide surfaces 9*a*, so that the pair of press-connecting blades 9 positively grip the electric wire 7 through the sheath 7*a* in a press-connected manner.

On the other hand, each of the other pairs of press-connecting blades 10 gradually compress and deform the sheath 7*a* and conductor 7*b* of the electric wire 7, press-fitted in the direction of arrow A, by their respective edged, tapering guide surfaces 10*a* in accordance with the diameter of the electric wire 7. Then, when the electric wire 7 is further press-fitted into the gap between the pair of press-connecting blades 10, the sharp edges 10*b* cut the sheath 7*a*, and subsequently the downwardly-extending inner surface portions of these blades 10 contact the conductor 7*b* at these cut portions of the sheath 7*a*.

Figure 6:
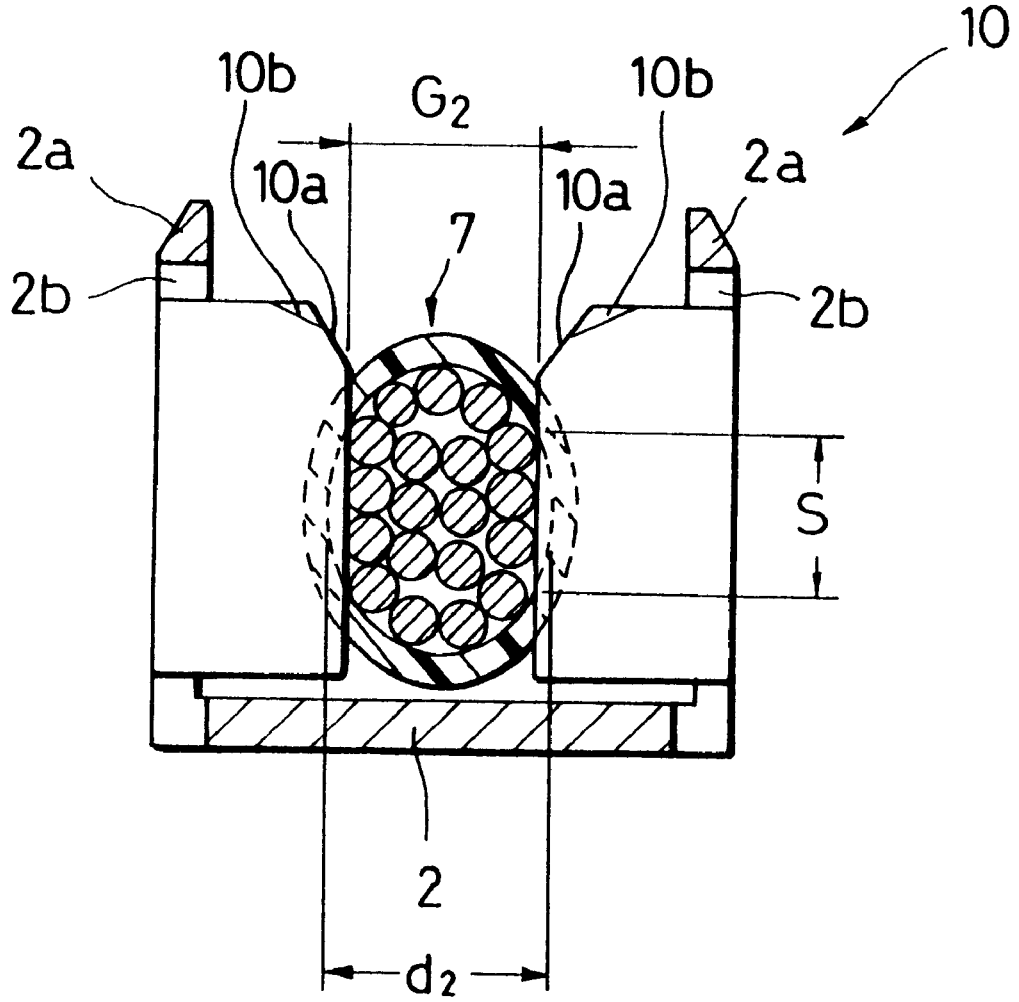
FIG. 6 is a transverse cross-sectional view showing press-connecting blade s which can be press-connected to a conductor of an electric wire of a different diameter in electrically-contacted relation thereto.
Figure 7:
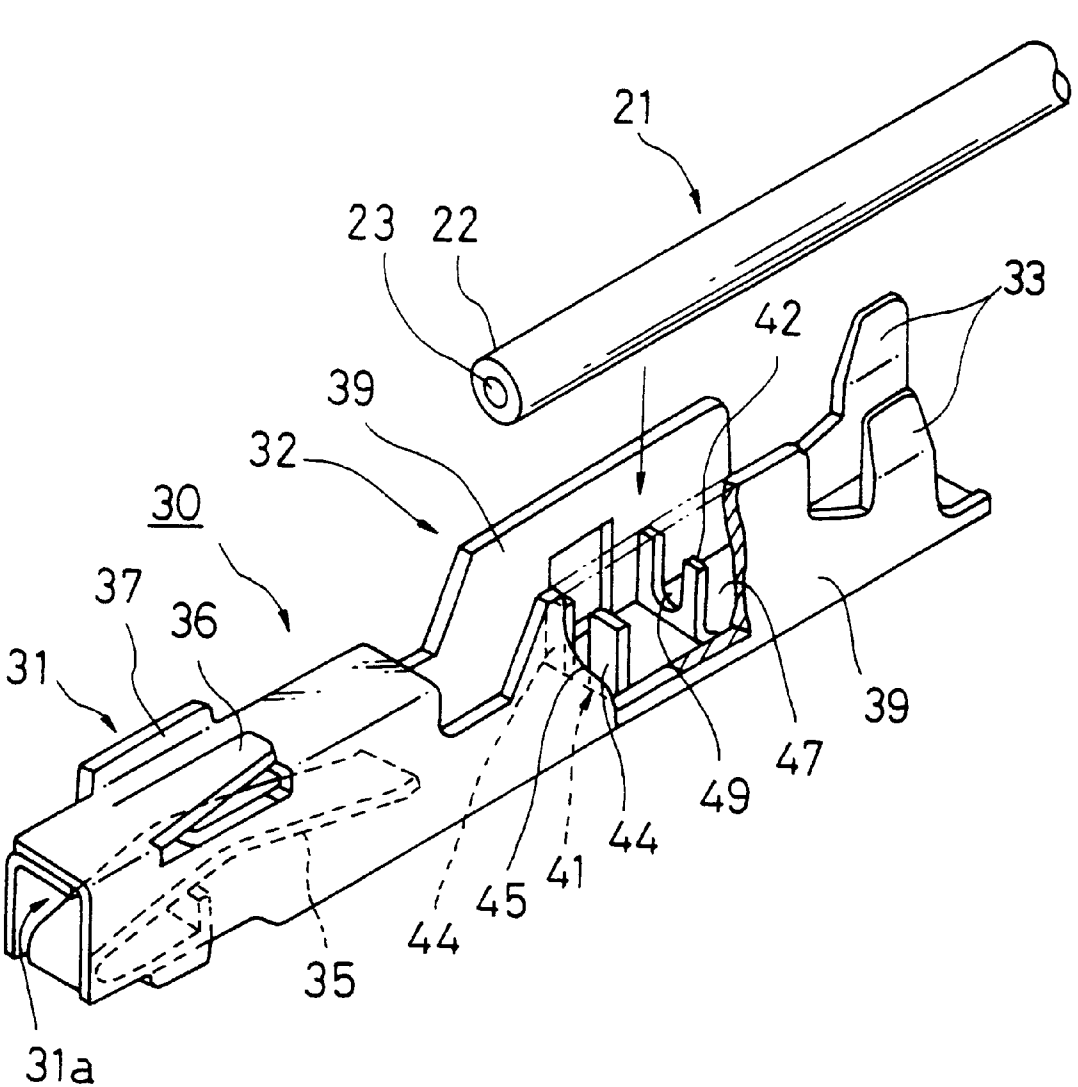
FIG. 7 PRIOR ART
FIG. 7 is a perspective view of a conventional press-connecting terminal.
Figure 8:
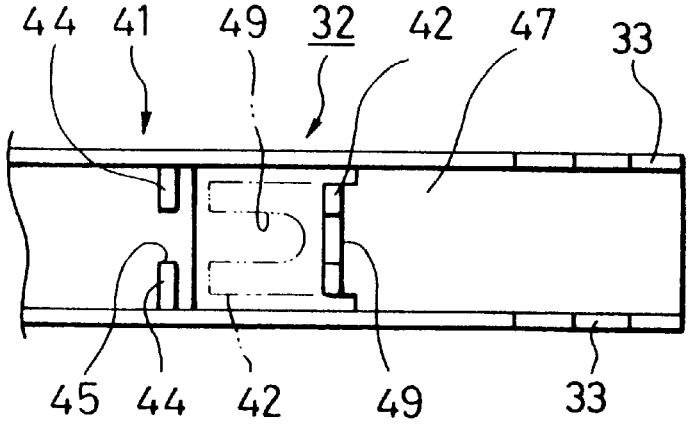
FIG. 8 PRIOR ART
FIG. 8 is a partly-broken, plan view of the conventional press-connecting terminal, showing the formation of press-connecting blades.
Figure 9:
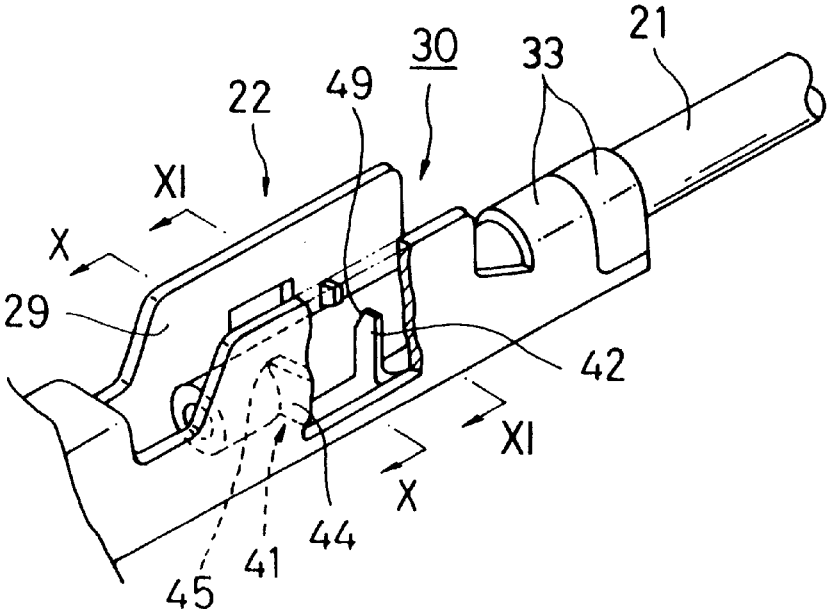
FIG. 9 PRIOR ART
FIG. 9 is a perspective view showing the manner of connecting an electric wire to the conventional press-connecting terminal.
Figure 10:
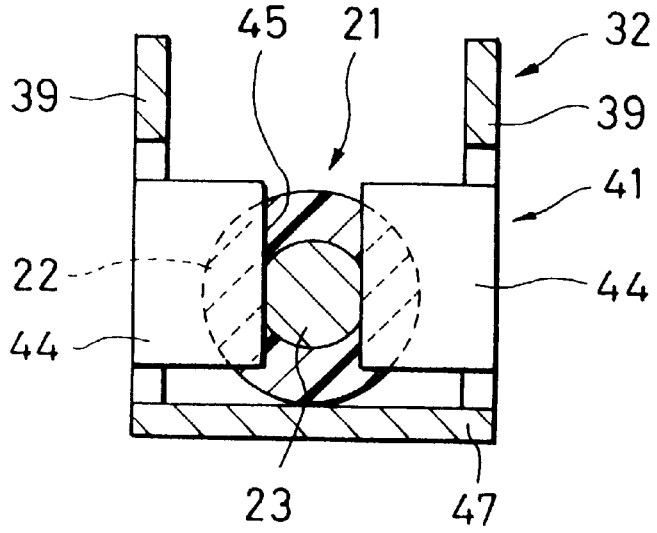
FIG. 10 PRIOR ART
FIG. 10 is a cross-sectional view taken along the line X—X of FIG. 9.
Figure 11:
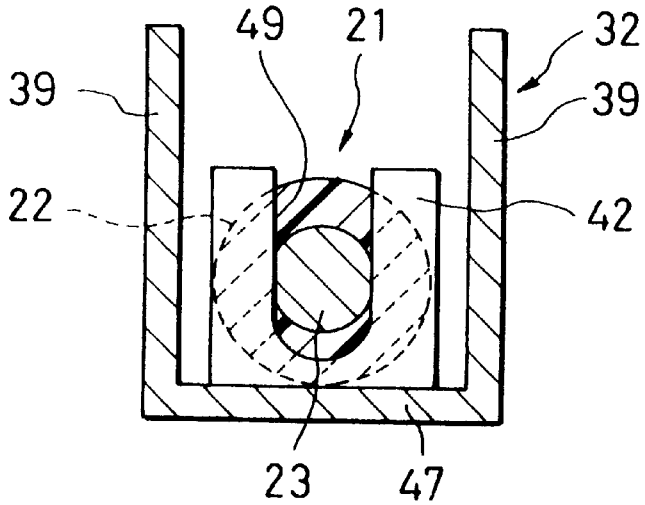
FIG. 11 PRIOR ART
FIG. 11 is a cross-sectional view taken along the line XI—XI of FIG. 9.

The conductor 7*b* is a so-called stranded conductor having a group of thin electric wires twisted together. If the gap $G_2$ is smaller than the diameter $d_2$ of the conductor 7*b* ($G_2<d_2$) as shown in FIG. 4, the conductor 7*b* is press-connected to the downwardly-extending inner surface portions of the pair of press-connecting blades 10 in a vertically-extended manner as indicated in solid lines of FIG. 4. As shown in FIG. 6, when the electric wire 7, having the conductor 7*b* of a different diameter $d_2$, is used, the conductor 7*b* is deformed in a vertical direction, and the sheath 7*a* is cut.

Each pair of press-connecting blades 9, 10 are formed respectively by inwardly bending the relevant portions of opposite side plates 2*a* of metal, and therefore the width of the downwardly-extending inner surface portions of each pair of press-connecting blades 10 for contact with the conductor 7*b* are equal to the thickness t of the opposite side plates 2*a* of metal. If the length of contact of the downwardly-extending inner surface portion with the conductor 7*b* is represented by S, the area W of contact of the downwardly-extending inner surface portion with the conductor 7*b* is expressed by $W=S\times t$. Since the pair of press-connecting blades 10 contact the opposite sides of the conductor 7*b*, respectively, the total area of contact $W_T$ is expressed by $W_T=2S\times t$. Therefore, since the plurality of pairs of press-connecting blades 10 are provided, the areas of contact of the downwardly-extending inner surface portions (which define the respective gaps $G_2$) of the pairs of press-connecting blades 10 with the conductor 7*b* are increased, and the contact resistance thereof is greatly reduced, so that the good electrically-connected condition is obtained.

And besides, in the press-connecting terminal 1 of the present invention, the pair of opposed press-connecting blades 9, which can grip the sheath 7*a* of the electric wire 7 in a press-connected manner, are provided adjacent to the connection portion 3, and with this construction when the press-connecting terminal 1 is fittingly connected to an electronic equipment or the like, these press-connecting blades 9 positively hold the electric wire 7 within the press-connecting portion 4 against an external force, such as external vibrations and a pulling force, applied to the electric wire 7.

The length of the sharp edge 10*b* of the edged, tapering guide surface 10*a* is suitably determined in accordance with the inclination angle, the inclination length, the diameter range of the electric wires and so on, and therefore the sharp edge 10*b* can be formed over the entire length of the tapering guide surface 10*a*, thus eliminating the flat guide surface portion thereof.

The pair of press-connecting blades 9 may not be provided adjacent to the connection portion 3, but may be provided between the two pairs of press-connecting blades 10. And, the press-connecting blades 9, as well as the press-connecting blades 10, may be provided in one or more pairs.

The press-connecting terminal of the present invention, described above, achieves the following novel effects.

The one pair of press-connecting blades can allow any one of the electric wires (varying in diameter from a predetermined maximum value to a predetermined minimum value) to be press-fitted into the gap therebetween while gradually compressing and deforming the sheath and conductor by their respective tapering guide surfaces, so that these press-connecting blades positively grip the electric wire through the sheath in a press-connected manner.

On the other hand, each of the other pairs of press-connecting blades gradually compress and deform the sheath and conductor of the electric wire, press-fitted therein, by their respective edged, tapering guide surfaces in accordance with the diameter of the electric wire, and then the edged, tapering guide surfaces cut the sheath, and the downwardly-extending inner surface portions of these blades, defining the gap therebetween, contact exposed portions of the conductor, thereby obtaining a good electrically-connected condition.

In the press-connecting terminal of the present invention, the pair of press-connecting blades, which can grip the sheath of the electric wire in a press-connected manner, are provided adjacent to the connection portion. With this construction, when the press-connecting terminal is fittingly connected to an electronic equipment or the like, these opposed press-connecting blades positively hold the electric wire within the press-connecting portion against an external force, such as external vibrations and a pulling force, applied to the electric wire.

In the press-connecting terminal of the present invention, there are provided the plurality of pairs of press-connecting blades which can electrically contact the conductor of the electric wire in a press-connected manner, and therefore the areas of contact of the downwardly-extending inner surface portions (which define the respective gaps) of these press-connecting blades with the conductor are increased, and the contact resistance thereof is greatly reduced, so that the good electrically-connected condition is obtained.

As described above, although the press-connecting terminal of the present invention can be satisfactorily press-connected to the electric wire regardless of the diameter of the electric wire, a variation in electric wire diameter is not unlimited, but the electric wire diameter should be in a predetermined range around the reference wire diameter. Despite this, any one of various wires of different diameters, falling within the predetermined range, can be press-connected to one press-connecting terminal, and therefore the press-connecting terminal has enhanced versatility.

What is claimed is:

1. A press-connecting terminal, comprising:

an electrically-conductive plate including a connection portion electrically connectable to another terminal, and a press-connecting portion to which an electric wire including a conductor and a sheath circumscribing the conductor is electrically connectable;

a first pair of press-connecting blades disposed in the press-connecting portion, the first pair of press-connecting blades having straight inner surfaces being opposed to each other to form therebetween a first gap into which the electric wire is insertable so that an outer surface of the sheath of the electric wire is gripped and deformed between the straight inner surfaces of the first pair of press-connecting blades;

a second pair of press-connecting blades disposed in the press-connecting portion, the second pair of press-connecting blades being opposed to each other to form therebetween a second gap into which the electric wire is insertable so that the sheath of the electric wire is pierced by the second pair of press-connecting blades, and the conductor of the electric wire is electrically connected to the second pair of press-connecting blades; and a third pair of press-connecting blades formed in the press-connecting portion, the third pair of press-connecting blades being opposed to each other to form therebetween a third gap into which the electric wire is insertable so that the sheath of the electric wire is pieced by the third pair of press-connecting blades, and the conductor of the electric wire is electrically connected to the third pair of press-connecting blades.

2. The press-connecting terminal of claim 1, wherein a width of the second gap is slightly larger than a width of the first gap.

3. The press-connecting terminal of claim 1, wherein when the electric wire is inserted into the first gap and the second gap, the first and second pairs of press-connecting blades are respectively arranged in intersecting relation to an axis of the electric wire.

4. The press-connecting terminal of claim 1, wherein the second pair of press-connecting blades have edged portions for piercing the sheath of the electric wire.

5. The press-connecting terminal of claim 1, wherein the first pair of press-connecting blades are located adjacent to the connection portion.

6. The press-connecting terminal of claim 1, wherein the first, second and third pairs of press-connecting blades are respectively arranged substantially parallel with each other.

7. The press-connecting terminal of claim 1, wherein the first and second pairs of press-connecting blades are respectively arranged substantially parallel with each other.

8. The press-connecting terminal of claim 1, wherein the electrically-conductive plate includes a bottom plate, wherein the press-connecting portion includes a pair of side plates extending upwardly in the same direction from opposite sides of the bottom plate, and wherein the first and second pairs of press-connecting blades are extended respectively from the side plates, and are located above the bottom plate.

9. The press-connecting terminal of claim 1, wherein the electrically-conductive plate includes a bottom plate, wherein the press-connecting portion includes a pair of side plates extending upwardly in the same direction from opposite sides of the bottom plate, and wherein the first, second and third pairs of press-connecting blades are extended respectively from the side plates, and are located above the bottom plate.

10. The press-connecting terminal of claim 1, wherein the electrically-conductive plate includes a bottom plate, and wherein the press-connecting portion includes a pair of clamping pieces for clamping the electric wire through the sheath thereof, the pair of clamping pieces extending upwardly from opposite sides of the bottom plate.

11. The press-connecting terminal of claim 1, wherein the first pair of press-connecting blades serve only as means for gripping the outer surface of the sheath of the electric wire, and the second pair of press-connecting blades serve only as means for piercing the sheath of the electric wire and for electrically connecting with the conductor of the electric wire.

12. The press-connecting terminal of claim 1, wherein the first pair of press-connecting lades serve only as means for gripping the outer surface of the sheath of the electric wire, and the second and third pairs of press-connecting blades serve only as means for piercing the sheath of the electric wire and for electrically connecting with the conductor of the electric wire.

13. The press-connecting terminal of claim 1, wherein first tapering guide-surfaces are formed on the first pair of press-connecting blades to be downwardly inclined respectively toward the first gap, and second tapering guide-surfaces are formed on the second pair of press-connecting blades to be downwardly inclined respectively toward the second gap, and wherein the electric wire is inserted into as the first and second gaps while being guided by the first and second tapering guide-surfaces.

14. The press-connecting terminal of claim 1, wherein first tapering guide-surfaces are formed on the first pair of press-connecting blades to be downwardly inclined respectively toward the first gap, second tapering guide-surfaces are formed on the second pair of press-connecting blades to be downwardly inclined respectively toward the second gap, and third tapering guide-surfaces are formed on the third pair of press-connecting blades to be downwardly inclined respectively toward the third gap, and wherein the electric wire is inserted into the first, second and third gaps while being guided by the first, second and third tapering guide-surfaces.

* * * * *